US005288392A

United States Patent [19]

Santos

[11] Patent Number: 5,288,392

[45] Date of Patent: Feb. 22, 1994

[54] PROCESS FOR CONVERTING ACID SLUDGE TO INTERMEDIATE SLUDGE

[76] Inventor: Benjamin S. Santos, 38735 Hungington Cir., Fremont, Calif. 94536

[21] Appl. No.: 879,642

[22] Filed: May 7, 1992

[51] Int. Cl.[5] ..... C10G 17/02; C10G 19/02; C10G 19/073

[52] U.S. Cl. ..... 208/13; 208/179; 208/182; 208/183; 210/710

[58] Field of Search ..... 210/710, 724, 738, 770, 210/792, 721; 106/284.03, 284.04; 208/4, 13, 177, 179, 181, 182, 183

[56] References Cited

U.S. PATENT DOCUMENTS

| | | | |
|---|---|---|---|
| 3,625,881 | 12/1971 | Chambers et al. | 208/179 |
| 4,038,087 | 7/1977 | Sugisaki et al. | 106/32 |
| 4,053,859 | 7/1977 | Davidson et al. | 208/179 |
| 4,144,162 | 3/1979 | Edgar et al. | 210/751 |
| 4,238,241 | 12/1980 | Schneider | 106/281 R |
| 4,279,865 | 7/1981 | Lyakhevich et al. | 422/187 |
| 4,331,481 | 5/1982 | Schneider | 106/283 |
| 4,559,128 | 12/1985 | Goodrich | 208/22 |
| 5,049,256 | 9/1991 | Luce | 208/13 |

OTHER PUBLICATIONS

Encyclopedia of Chemical Technology, 3rd Ed. vol. 3 Kirk-Othmer, pp.299-302.

Nelson, W. L. Petroleum Refinery Engineering, 4th Ed., McGraw-Hill Book Company, Inc. pp. 261, 293-297 (1958).

1980 Annual Book of ASTM Standards, Part 23, Petroleum Products and Lubricants (I), D56-D1660, American Society for Testing and Materials, pp. 454-461.

*Primary Examiner*—Neil M. McCarthy

*Attorney, Agent, or Firm*—Ronald C. Fish

[57] ABSTRACT

A process for converting the acid sludge produced by waste oil refineries into an acid sludge intermediary which can be used in the production of asphaltic mixtures. The process includes contacting the entire surface area of acid sludge with a pH altering agent such as an aqueous inorganic liquid, and separating the liquid layer from the sludge layer, thereby producing an intermediate sludge having properties which make it suitable for use in asphalt production.

13 Claims, 7 Drawing Sheets

PROCESS FOR CONVERTING ACID SLUDGE TO INTERMEDIATE SLUDGE

BACKGROUND OF THE INVENTION

1. Field of the Invention

The present invention pertains to the field of acid sludge disposal and in particular to a process for disposing of acid sludge by converting the acid sludge into a useful compound, specifically asphalt.

2. Description of the Prior art

Because of the huge volume of used crankcase oil from vehicle engines and the oil shortage, an oil recycling industry has grown up. In the prior art, oil recycling generates a toxic byproduct called acid sludge. The volume of acid sludge generated in the recycling process is approximately 20–30% of the volume of the waste oil input. In the prior art, this acid sludge was dumped. However, it is very acidic and it contains many heavy metals and other toxic compounds which are harmful to the environment. Further, acid sludge is not biodegradable. Therefore a need has arisen to process the acid sludge to either eliminate it or convert it to a useful product.

Due to the substantial environmental concerns relating to acid sludge disposal, it is deemed desirable to have a process to convert acid sludge into an intermediate sludge that can be used in the same manner in which bituminous compounds are used to produce asphalt. Such a process would have far reaching economic and environmental importance. Specifically, the environmental and ecological pollution which results from acid sludge disposal would be reduced.

Acid sludge is a waste product produced by waste oil re-refineries. In the process of re-refining waste oil, one of the goals is to achieve an oil having the qualities of virgin oil.

One method of refining used oil to the quality of near virgin oil requires treating the oil with sulfuric acid. Sulfuric acid is added to oxidize and remove carbonaceous impurities, metal components and other oxidizable materials from the used oil. The addition of sulfuric acid causes a phase separation to occur in which there is generated a layer of relatively pure oil and a layer of acid sludge. The acid sludge settles and is removed. In this used oil refining process, the acid sludge is approximately 5% by volume of 98% sulfuric acid and has a pH less than 2 and typically a pH of 0.1. Consequently, this acid sludge is highly acidic, is considered toxic, and is not biodegradable. Disposal of this sludge is increasingly regulated by the environmental protection agencies of most federal and state governments. In addition, during these re-refining processes, large volumes of acid sludge are produced. The volume of acid sludge produced is approximately 0.25 gallons per gallon of used oil. In the years preceding 1980 this amounted to over 2 million tons of acid waste per year. Today, the volume of acid sludge may even be greater, but this is unclear.

Traditional methods of acid sludge disposal are landfill, incineration, acid recovery, neutralization, and disposal to water. These disposal options have a number of drawbacks. For example, as much as 30 to 50% of the acid sludge is water soluble. Therefore if the acid sludge is disposed of in a landfill, components of the sludge can leach into the water table and cause hazardous health conditions. In addition, incineration and neutralization of acid sludge produce toxic gaseous emissions to the atmosphere. These emissions include sulfur and sulfur dioxide which are leading causes of acid rain which is causing great damage to Canadian, English and Scottish forests. Acid recovery from the acid sludge is too expensive on the small scale and the high transportation costs make justification of a centralized location very difficult. Finally disposal to waste water can only be practiced where high volume waste water treatment facilities are available for dilution.

These traditional methods of disposal are very detrimental to the environment. In addition these traditional methods are becoming more and more costly as the regulatory requirements governing them increase.

There are prior art processes which combine acid sludge with other compounds to produce asphalt. (Schneider U.S. Pat. Nos. 4,238,241 and 4,331,481). These processes involve adding the acid sludge to preexisting asphalt or to a mixture of asphalt and aggregate. The acid sludge used is only a small fraction of the end product. Therefore, these processes fail to use significant amounts of the acid sludge and, consequently, they do not significantly decrease the amount of acid sludge in existence.

SUMMARY

According to the teachings of the invention, a process for converting acid sludge to asphalt is provided. The first step in this process is to raise the pH of the acid sludge to a level not so high that the acid sludge becomes sandy at room temperature but high enough that the acid sludge will not become sandy when heated. Generally, the desirable pH range is between 3–7. Generally any agent may be mixed with the acid sludge to raise its pH, although there are some restrictions. Generally, the preferred agents are water, acid of a higher pH, or weak or strong bases and salt solutions in that order.

The acid sludge, after raising its pH, is an intermediate sludge which can be used to create "blown asphalt," or hard, oxidized asphalt that is commercially valuable. The process to convert the intermediate sludge to "blown asphalt" is known in the prior art. Generally this process involves heating the intermediate sludge to 200–270 degrees centigrade, preferably 230 degrees centigrade, and blowing air through it for approximately 10–20 hours. The air flow rate is preferably 50 cubic feet per minutes. Higher air flow rates or higher temperatures shorten the time necessary to produce "blown asphalt." The preferable penetration number indicative of the desired hardness of the resulting asphalt is 6–5.

DETAILED DESCRIPTION OF THE PREFERRED EMBODIMENT

Figure 1:
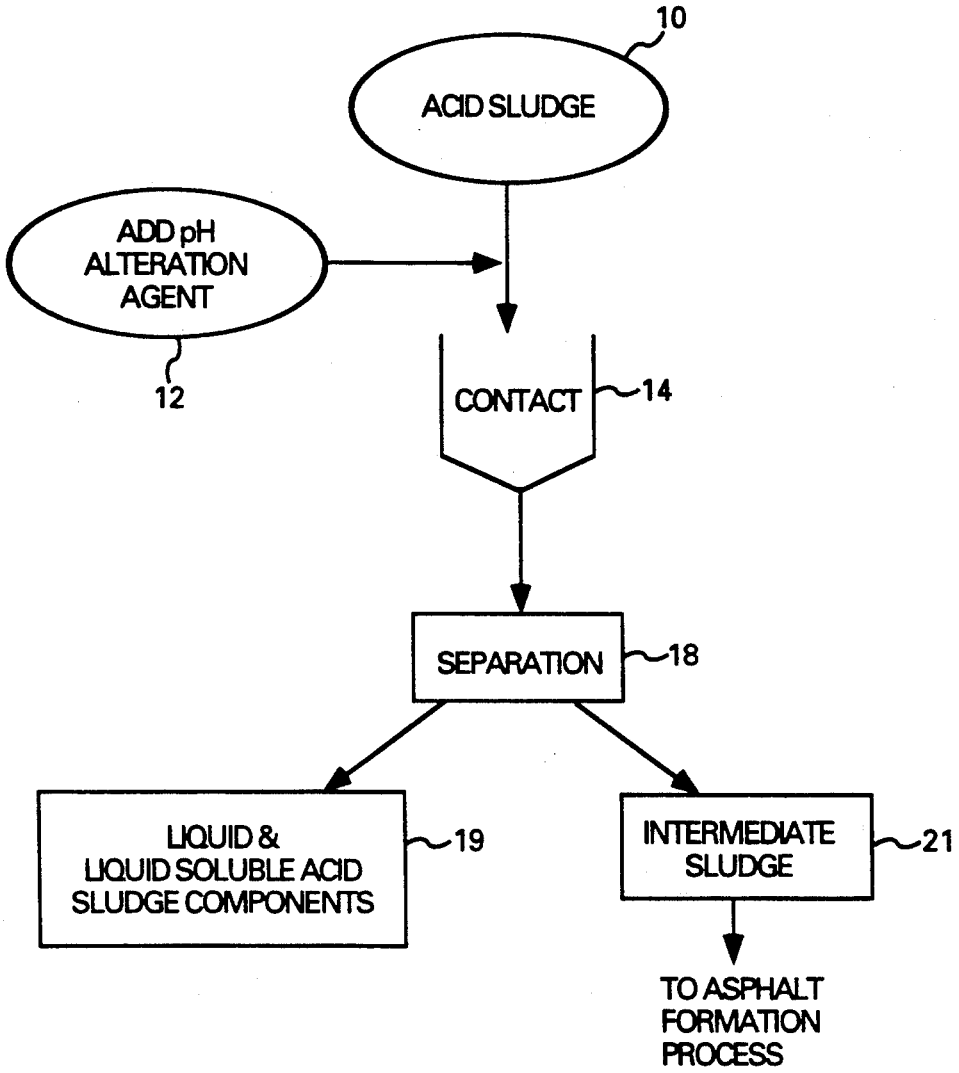
FIG. 1 is a schematic diagram of the conversion process of the present invention.

Referring to FIG. 1, the present invention is a process for converting acid sludge into an intermediate sludge which can be converted by known methods into an asphalt mixture. The process will enable acid sludge to be utilized in a useful manner and will eliminate the need to dispose of it with all the attendant problems. The process comprises: providing acid sludge, symbolized by step 10; contacting the acid sludge with an agent to increase the pH of the acid sludge, such as a liquid or solid of sufficient pH so as to produce a mixture which is both nongranular at room temperature and nongranular when subjected to heating as symbolized by steps 12 and 14 in FIG. 1; and separating the pH altering agent from the mixture, as symbolized by steps 18, 19 and 21. These two steps of introducing the pH modifying agent and contacting it with the acid sludge create an intermediate sludge which is useful in the production of asphalt.

The starting material for the process of the present invention is acid sludge that is generated in the process of re-refining used lubricating oil. Generally the acid sludge is a byproduct of the re-refining process resulting from the addition of sulfuric acid and clay to the waste oil. The sulfuric acid sludges are difficult to define chemically, but typically they can contain sulfuric acid esters, sulfonic acids, salts of nitrogen bases, resinous and asphaltic materials, sulfur compounds dissolved from the oil, hydrocarbon polymers, condensation products and entrained oil. The composition varies with the nature of the oil fraction, treating conditions and time of storage.

The acid sludge that is the starting material in the present process can be acid sludge from any oil refining process that utilizes acid. One oil re-refining process is acid-clay re-refining of used mineral lubricating oil (industrial or automotive). Alternatively, the acid sludge could be an acid sludge that has been in a temporary holding pit or the like. Generally the acid sludge will have a pH of about $\leqq 3$ and, typically, will have a pH of 0.1.

It is desirable to convert the acid sludge into a higher pH intermediate sludge to make it useful for formation of useful end products such as "blown asphalt". "Blown asphalt" is a particular species of asphalt having significant commercial value. The process to make this asphalt requires heating to a high enough temperature so as to remove aqueous components. Unfortunately the level of heat required will immediately turn acid sludge having a pH of approximately 0.1 into a sandy mixture which will not melt. Such sandy mixtures are not useful in making asphalt.

Figure 2:
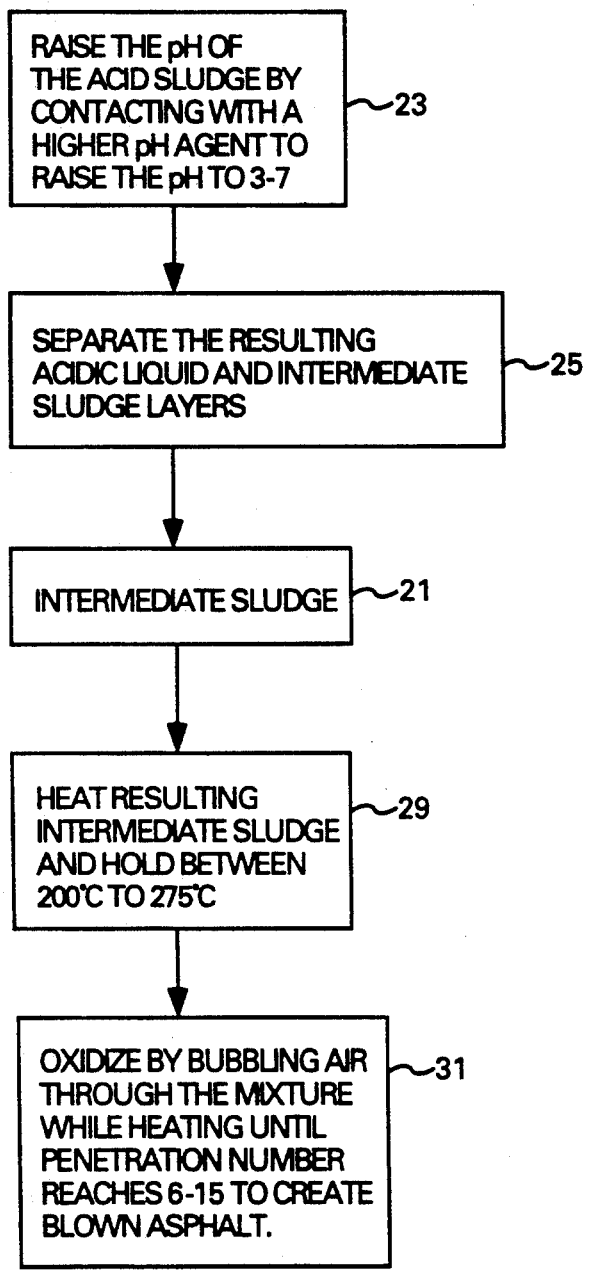
FIG. 2 is a process flow diagram of a process according to the invention using a liquid pH alteration agent.

Therefore, according to the teachings of the invention, the pH of the acid sludge material is increased by contacting the acid sludge with a pH altering agent to raise the pH to a level such that the sludge will not be granular at room temperature nor become granular upon heating. FIG. 2 is a process flow diagram showing the preferred process for converting acid sludge to blown asphalt. The process comprises the steps of: raising the pH of the acid sludge by contacting it with a liquid pH altering agent having a pH preferably from 3 to 14 as symbolized by step 23; separating the resulting liquid pH altering agent and intermediate sludge layers as symbolized by step 25; heating the intermediate sludge (21) to a temperature between 200° C. and 275° C. as symbolized by step 29; and, oxidizing the heated intermediate sludge until the penetration number reaches 6–15, as symbolized by step 31.

The step of raising the pH of the acid sludge is symbolized by step 23. Preferably the step of raising the pH is performed by contacting the acid sludge with a liquid having a pH significantly higher than 0.1, and preferably higher than about 3. In other embodiments, the agent used to raise the pH can be a solid. The preferred agent is water which is mixed with the acid sludge to serve the function of increasing the pH thereof to a level sufficient to prevent formation of granules upon heating but not raising the pH so high as to create granules at room temperature.

The pH of the pH altering agent utilized in the present invention bears a functional relationship with the acid sludge. If the pH altering agent has a pH which is too high or if too much pH altering agent is added, as indicated above, the acid sludge will become granular at room temperature. On the other hand, if the pH of the pH altering agent is too low, the sludge will become granular when the temperature of the mixture is elevated. Accordingly, the pH of the added pH altering agent must be sufficient to cause the pH of the acid sludge to increase to a pH in the range of generally from about 3–7.

The liquid pH altering agent can be selected from the group comprising water, inorganic liquids, organic liquids, and dilute acids or bases. In particular, the pH altering agent can be selected from the group comprising: dilute strong acids, weak acids, salt solutions and dilute bases such as: lime, ammonia, caustic soda or soda ash and the like. Preferably the pH altering agent is of pH in the range of from 3–14. Most preferably the pH altering agent is water. Some of the characteristics which make water a preferred pH altering agent are that water is generally inexpensive and has pH 7.

The amount of pH altering agent required in the process of the present invention will depend upon the initial pH of the acid sludge, the amount of the acid sludge and the pH of the pH altering agent being used. The amount of pH altering agent will be that quantity which is necessary to remove or neutralize the residual sulfuric acid in the acid sludge and thereby increase the pH of the acid sludge to a pH sufficient to meet the functional granularity requirements stated above, generally in the range of from 3–7. Thus, the amount of the pH altering agent, like the pH of the agent, is situation dependent. For example, if the pH altering agent is water, the volume of water should be approximately 3 to 7 times the volume of acid sludge. On the other hand, if the pH altering agent is a caustic liquid, i.e.; a liquid having a pH greater than 7, less pH altering agent will be required.

Since all of the components of acid sludge are not soluble in the liquid pH altering agent, the liquid pH altering agent and acid sludge will not form a homogenous mixture. In the absence of agitation, the liquid pH altering agent and the acid sludge will form two layers. Therefore, in the process of the present invention, after the acid sludge has been sufficiently contacted with the pH altering agent, the liquid pH altering agent and the acid sludge will separate and form two layers: a liquid layer and an intermediate sludge layer. The sulfuric acid and other water soluble components of the acid sludge starting material are now present in the liquid layer.

Figure 3A:
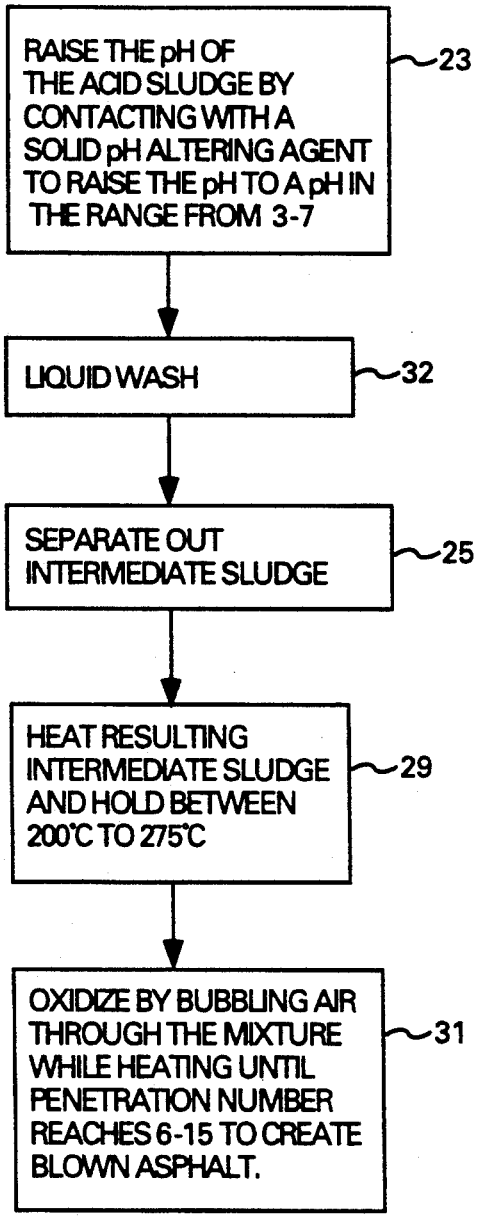
FIG. 3A is a process flow diagram of a process according to the invention to convert acid sludge to blown asphalt using a solid pH altering agent and including a liquid wash step.

This liquid layer is removed from the acid sludge and disposed of as symbolized by step 18 in FIG. 1 and step 25 in FIGS. 2 and 3A. Processes by which the acid liquid layer can be removed from the intermediate sludge include decanting, suctioning, separating and the like. The process of contacting the liquid pH alteration agent with the acid sludge followed by liquid layer removal is continued until the pH of the intermediate sludge is generally in the range of from 3-7. The pH of the resulting intermediate sludge can be measured via the strong acid number. The methods for performing strong acid number measurement are well known by those skilled in the art. A standard test method can be found in the 1980 Annual Book of ASTM Standards D974, part 23, Petroleum Products and Lubricants. This method measures strong acid number by placing a sample of the acid sludge in boiling water. The pH of this water can also be measured by using a pH test paper covering the full range of pH from 1-14 or by using a pH meter.

Figure 3B:
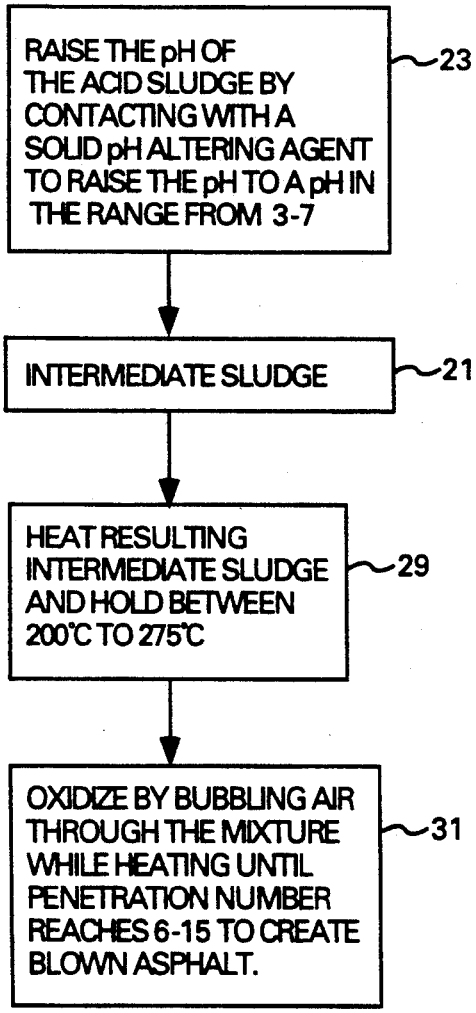
FIG. 3B is a process flow diagram of a process according to the invention to convert acid sludge to blown asphalt using a solid pH altering agent.

FIG. 3A is an alternative process flow diagram wherein a solid pH altering agent is used. Typical solid pH altering agents include lime, caustic soda, soda ash and the like. The solid pH altering agent is contacted with the entire surface area of the acid sludge in the same process as the liquid pH altering agent. However, when a solid pH altering agent is used, there is not a free liquid layer as there is when a liquid pH altering agent is used. When solid pH altering agents, such as caustic soda, lime, etc. are used, they react with the sulfuric acid to form salts and water. Therefore, after the solid is added, the mixture is washed (step 32) with liquid, usually water to remove the residue formed by the solid and then this liquid is separated (step 25) from the acid sludge. After washing and separating, the process of FIG. 3A proceeds in the same manner as the process of FIG. 2. Alternatively, after solid pH altering agents are added to the acid sludge, the resulting mixture may be heated as symbolized by step 29 in FIG. 3B without undergoing washing and separating steps symbolized by steps 32 and 25 in FIG. 3A. Thereafter, the process of FIG. 3B proceeds in the same manner as the process of FIG. 3A.

Figure 4:
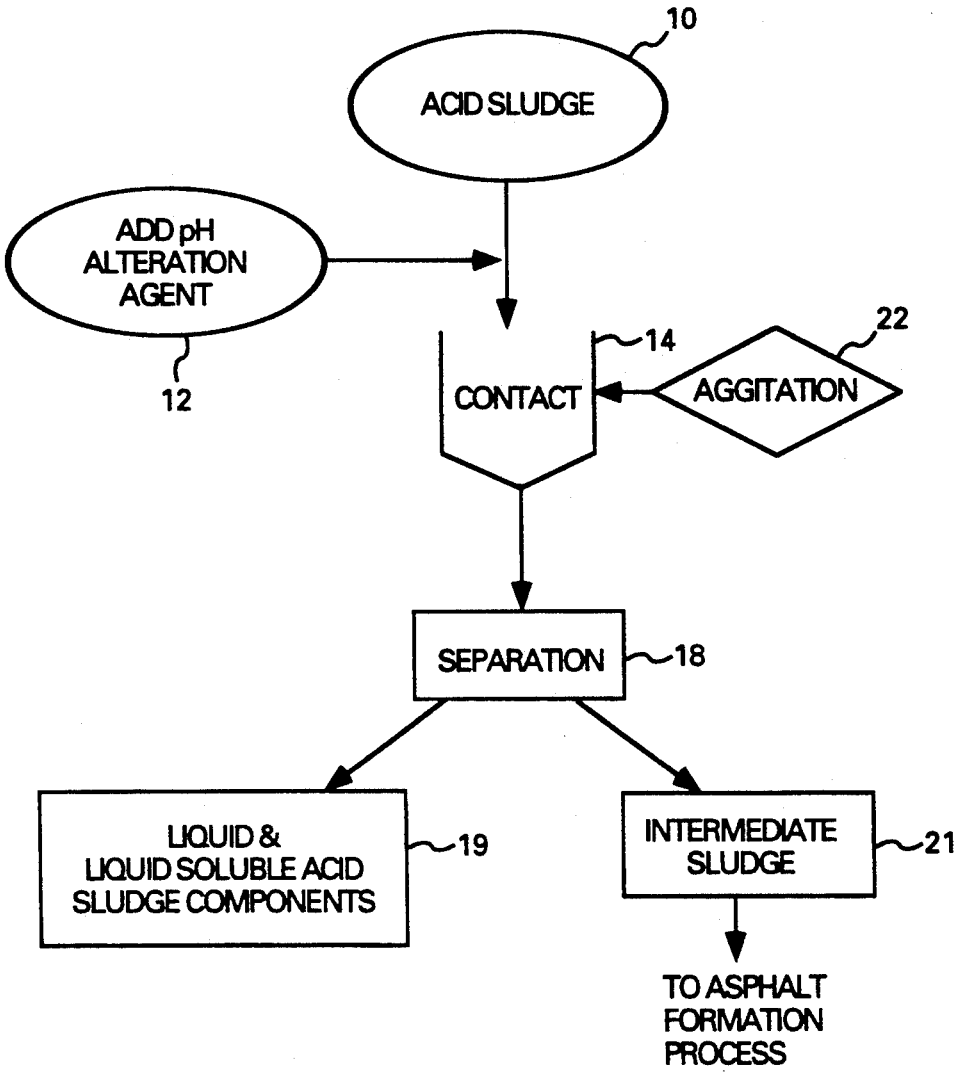
FIG. 4 is the schematic diagram of an alternative embodiment of the conversion process in FIG. 1 wherein the contacting step is enhanced through agitation.

Preferably the entire surface area of the acid sludge should be contacted with the pH altering agent. Therefore, in the preferred embodiment, the pH altering agent-acid sludge mixture is agitated, as symbolized by step 22 in FIGS. 4 and 6. Agitating the pH altering agent-acid sludge mixture will increase the degree of contact between the pH altering agent and the entire surface area of the acid sludge. The agitation should be sufficiently adequate so as to disperse the pH altering agent throughout the acid sludge. Some agitation processes include mixing, stirring, dispersion, vibration, shaking, milling, rolling, blending and the like.

Figure 5:
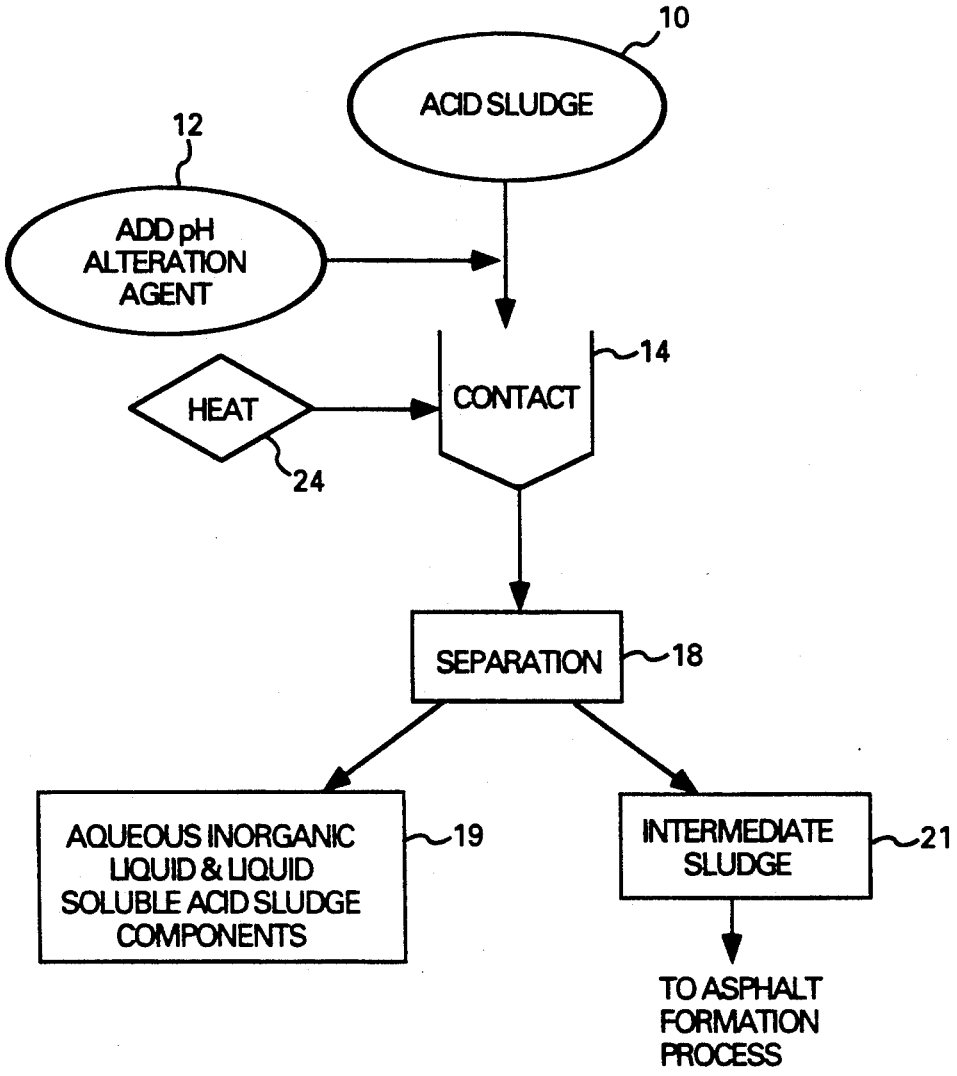
FIG. 5 is the schematic diagram of an alternative embodiment of the process shown in FIG. 1, wherein the contacting step is enhanced through heating.
Figure 6:
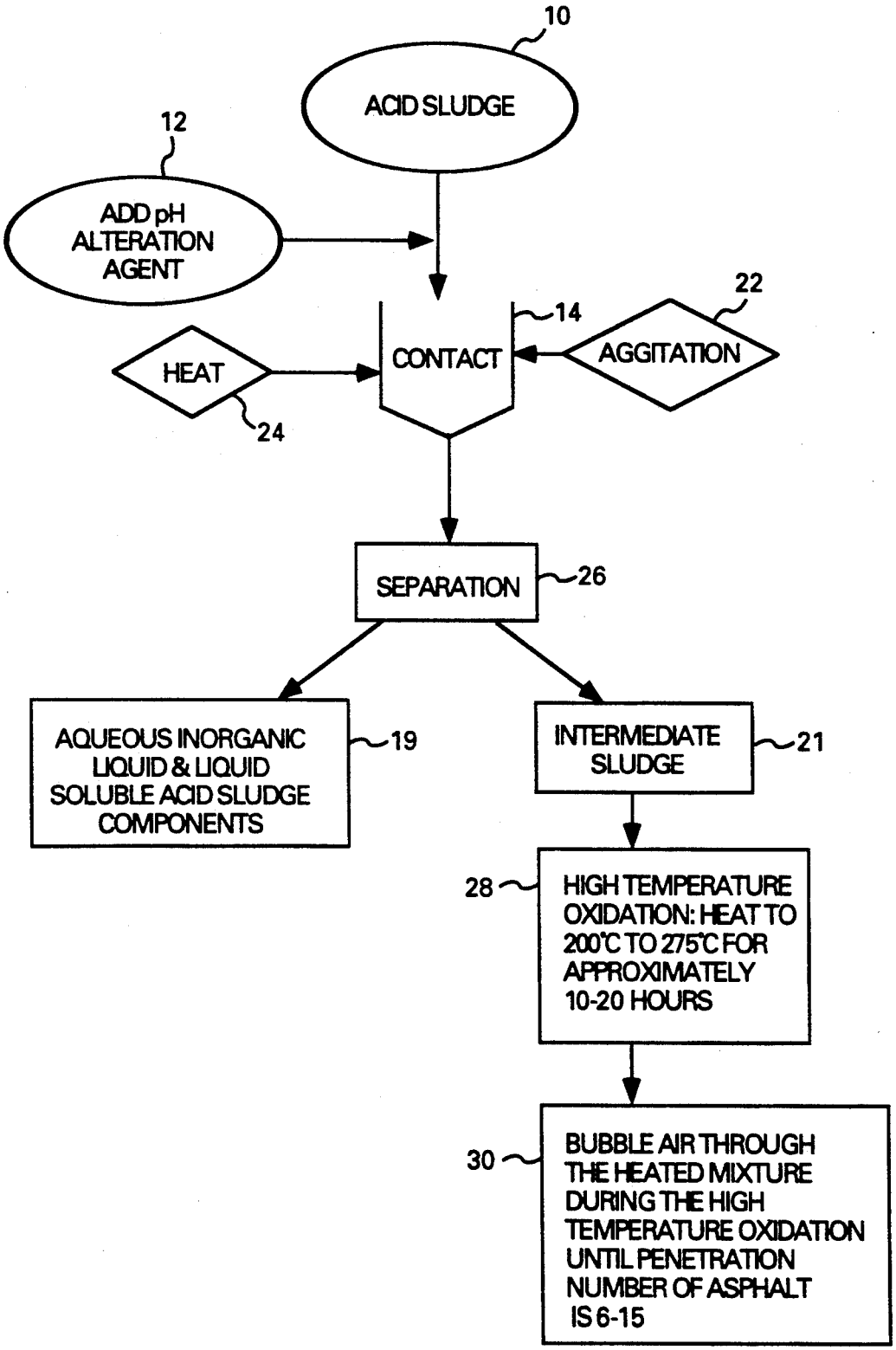
FIG. 6 is the schematic diagram of an alternative embodiment of the process shown in FIG. 1, wherein the contacting step is enhanced through agitation and heating and further detailing the process steps to convert the intermediate sludge to blown asphalt.

In another embodiment, the temperature of the pH altering agent-acid sludge mixture is elevated during the step of contacting the pH altering agent with the acid sludge as symbolized in FIGS. 5 and 6, by step 24. Acid sludge is very viscous and will not readily mix with the pH altering agent. Therefore, the temperature of the sludge can be elevated, at least during the interval of adding pH altering agent and contacting, to ease mixing thereby increasing the amount of acid sludge surface area with which the pH altering agent is contacted. Although the temperature is not critical, best results were obtained using a temperature greater than 100 degrees centigrade and preferably 190 degrees centigrade.

Referring to FIG. 6, there is shown a process for converting acid sludge to blown asphalt. The process of FIG. 6 comprises: providing acid sludge (step 10), contacting the acid sludge with a pH altering agent (steps 12 and 14), agitating and heating the pH altering agent-acid sludge mixture (steps 22 and 24), separating the liquid pH altering agent layer from the intermediate sludge layer to remove the liquid (step 26), heating the intermediate sludge to a temperature in the range from 200-275 degrees centigrade for an interval from 10-20 hours (step 28), dehydrating and oxidizing the intermediate sludge to form an asphaltic mixture by bubbling air through the heated mixture, preferably at a rate of 50-150 cubic feet/minute per ton (step 30). The oxidation continues until the penetration number is in the range from 6-15 and preferably from 8-10. The amount of time this takes depends upon the temperature selected and the rate of air flow through the intermediate sludge. For example, air blowing for approximately 10 hours at a temperature of 250° C. and an air rate of 50 cubic feet per minute will generally result in an asphalt mixture having an approximate penetration of 8 when measured at 25° C., 100 grams and 5 seconds, a R & B softening point of 100° C., and a flash point of 250° C. Higher temperatures or higher flow rates result in shorter intervals.

The purpose of the pH modification steps 12 and 14 are to avoid granularity problem which would prevent the melting necessary to form asphalt. The purpose of the heating step 28 is to drive off the aqueous compounds. The purpose of the oxidation step 30 is to make the resulting asphalt more brittle.

In a preferred embodiment, the steps 28 and 30 comprise raising the temperature of the intermediate sludge to 270 degrees centigrade, and blowing air through the heated mixture at a rate of 150 cubic feet per minute for 10 hours.

Asphalts are graded according to their penetration number and softening point. Typically soft asphalts have penetration numbers of 60-150 and above, and hard asphalts have penetration numbers of 4 to 20 or 25.

The resulting asphaltic mixture of bituminous compounds and chemical, can then be used in a number of applications. For example the asphaltic mixture of the present invention can be used in the production of soft or hard asphalts, water-proofing, rust prevention, vapor barrier, undercoating, underlaying or undersealing, priming and painting, insulation, lamination, battery sealant and paving materials. A particularly beneficial use of the bituminous compound produced by this process is the ability it has to form a hard asphalt mixture. In addition, the intermediate sludge could be added to soft asphalt to make the soft asphalt harder.

What is claimed is:

1. A process for converting acid sludge to intermediate sludge and for forming blown asphalt from said intermediate sludge, comprising:

altering the pH of the acid sludge by adding a sufficient volume of liquid pH elevating agent relative to a volume of said acid sludge being treated, said pH elevating agent having a pH ranging form 3 up to 14, said volume and pH of said pH elevating agent being sufficient as to raise the pH of said acid sludge to from approximately 3 to approximately 7 such that said acid sludge does not become sandy and unmeltable at temperatures from room temperature up to approximately 275 degrees centigrade, thereby creating an intermediate mixture comprising a liquid layer and a layer of intermediate sludge having a pH in the range from approximately 3 to approximately 7, and;

separating said liquid layer from said layer of intermediate sludge, and further heating and oxidizing said intermediate sludge to form blown asphalt.

2. The process of claim 1 wherein the liquid pH elevating agent is water.

3. The process of claim 1 further comprising the step of agitating the mixture of said liquid pH elevating agent and said acid sludge.

4. A process for converting said sludge to intermediate sludge and for forming blown asphalt from said intermediate sludge, comprising;

altering the pH of the acid sludge by adding a sufficient volume of solid pH elevating agent selected from the group consisting of lime, caustic soda, and soda ash, the volume of said solid pH elevating agent relative to the volume of said acid sludge being treated being sufficient as to raise the pH of said acid sludge to between approximately 3 and approximately 7 such that said acid sludge does not become sandy and unmeltable at temperatures from room temperature up to approximately 275 degrees centigrade, thereby creating an intermediate sludge having a pH in the range from approximately 3 to approximately 7, and further heating and oxidizing said intermediate sludge to form blown asphalt.

5. The process of claim 1 further comprising the step of heating said acid sludge after said acid sludge is in contact with said pH elevating agent.

6. The process of claim 3 further comprising the step of heating the acid sludge at least during the interval when said pH elevating agent has been added to said acid sludge.

7. The process of claim 1 further comprising the step of agitating the acid sludge while said pH elevating agent is in contact with said acid sludge, and further comprising the steps of heating said intermediate sludge to a temperature between approximately 200 and 275 degrees Centigrade after separation from said liquid layer, and, thereafter, bubbling air or oxygen through said heated intermediate sludge for an interval sufficient to obtain an oxidized asphalt having a penetration number from about 4 to 25.

8. The process of claim 4 further comprising the steps of heating and agitating the acid sludge at least during the interval when said pH elevating agent is added to said acid sludge.

9. The process of claim 4 wherein the steps of heating and oxidizing comprise the steps of:

raising the temperature of the intermediate sludge to a temperature in the range of from 200 degrees centigrade to 275 degrees centigrade; and passing air or oxygen through the intermediate sludge for an interval sufficient to oxidize the intermediate sludge and create blown asphalt having a penetration number of from 4 to about 25.

10. The process of claim 9 wherein the air or oxygen is passed through the intermediate sludge at a rate of from about 50 to 150 cubic feet per minute.

11. The process of claim 9 wherein the temperature of the intermediate sludge is raised to 270 degrees centigrade; and the air or oxygen is passed through the intermediate sludge at a rate of 150 cubic feet per minute for 10 hours.

12. The process of claim 1 further comprising the step of adding the intermediate sludge to a soft asphalt to make said soft asphalt harder.

13. The process of claim 4 further comprising the step of adding the intermediate sludge to a soft asphalt to make said soft asphalt harder.

* * * * *